United States Patent [19]

Schwarzmann

[11] 4,369,415

[45] Jan. 18, 1983

[54] SPACE-LOADED COAXIAL COUPLER

[75] Inventor: Alfred Schwarzmann, Mount Laurel, N.J.

[73] Assignee: RCA Corporation, New York, N.Y.

[21] Appl. No.: 232,690

[22] Filed: Feb. 9, 1981

[51] Int. Cl.[3] ..... H01P 5/12

[52] U.S. Cl. ..... 333/127; 333/22 R

[58] Field of Search ..... 333/123, 125, 127, 136

[56] References Cited

U.S. PATENT DOCUMENTS

| | | | |
|---|---|---|---|
| 2,714,706 | 8/1955 | Masters | 333/127 |
| 3,089,103 | 5/1963 | Oliner . | |
| 3,091,743 | 5/1963 | Wilkinson . | |
| 3,246,262 | 4/1966 | Wichert | 333/24.1 |
| 3,904,990 | 9/1975 | La Rosa . | |
| 4,163,955 | 8/1979 | Iden et al. . | |

OTHER PUBLICATIONS

Wilkinson, *An N-Way Hybrid Power Divider,* IRE Trans. on MTT, Jan. 1960, pp. 116–118.

Parad et al., *Split-Tee Power Divider,* IEEE Trans. on MTT., Jan. 1965, pp. 91–95.

Gysel, *A New N-Way Power Divider/Combiner Suitable for High Power Applications,* Proc. of 1975, IEEE MTT Seminar, pp. 116–118.

*Primary Examiner*—Paul L. Gensler

*Attorney, Agent, or Firm*—Samuel Cohen; Joseph S. Tripoli; Robert Ochis

[57] ABSTRACT

A coaxial transmission line power divider structure includes an inner conductor split to form branch legs. The split portions of the inner conductor are arranged to define a hollow interior. An odd mode power dissipation element is disposed within the hollow. A thermally conducting element carries heat from the power dissipation element to the outer conductor.

13 Claims, 14 Drawing Figures

Figure 5A:
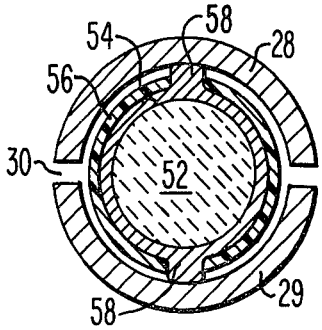

Fig. 1
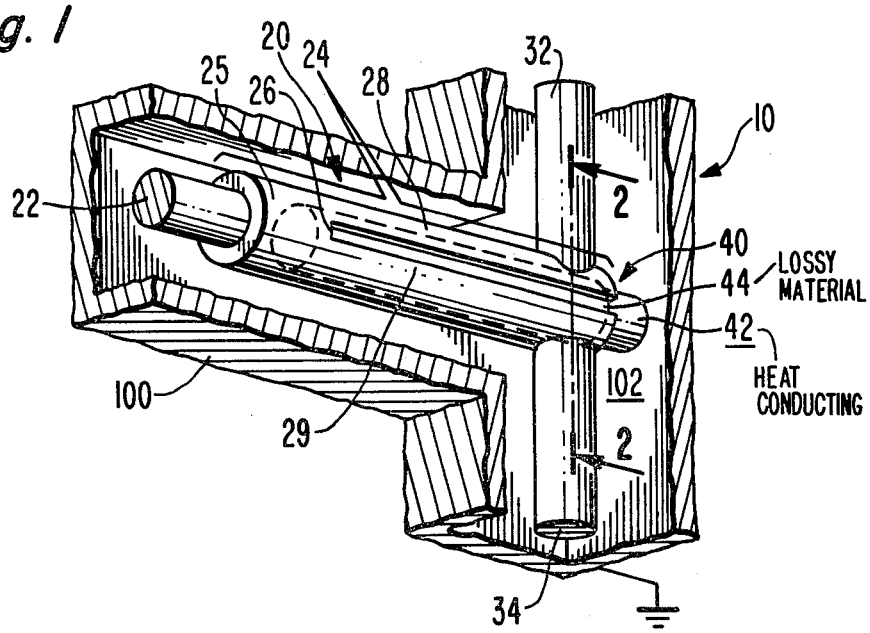
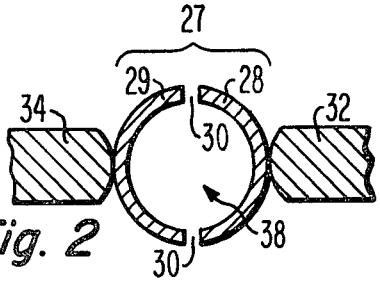
Fig. 2
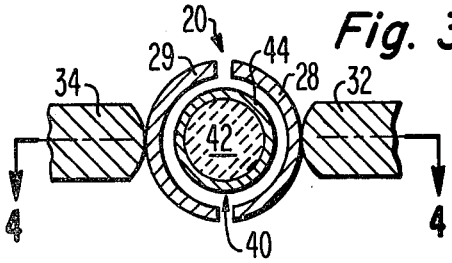
Fig. 3
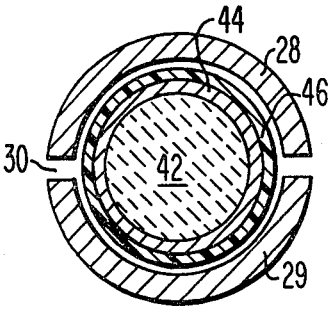
Fig. 4a
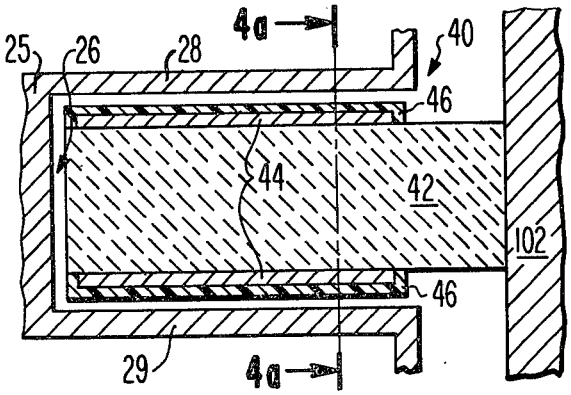
Fig. 4

SPACE-LOADED COAXIAL COUPLER

This invention is applicable to the field of high-frequency couplers and, more particularly, to the field of coaxial transmission line couplers.

An ideal, matched, microwave power divider has a common port and a plurality of branch ports or lines, divides input power applied to the common port among the branch ports in a predetermined ratio and provides isolation between the branch ports in order that reflections and other disturbances in one of the branch lines will not affect other branch lines.

A coaxial transmission line power divider providing isolation between the branch ports is described in a paper by Ernest J. Wilkinson entitled, "An N-Way Hybrid Power Divider," which appeared in the January 1960 issue of the *IRE Transactions on Microwave Theory and Techniques* at pages 116–118 and is the subject of his U.S. Pat. No. 3,091,743. In this divider the common port inner conductor is expanded into a hollow shell as a transformer section. The hollow shell is slit lengthwise into as many equal width splines as the number (N) of branch ports desired. A shorting plate at the beginning of the splines assures that all of the splines emanate from the same common junction. The slits and, thus, the splines are ¼ wavelength long at the designed operating frequency. This splined cylindrical shell can be considered a common-line to branch-lines transition portion of the divider. Each spline of the cylindrical shell has a different isolation or odd mode power dissipation resistor associated with it. All of the resistors have the same value. Each resistor has a first end connected to its associated spline ¼ wavelength from the common junction of the splines and a second end connected to the second ends of all the other resistors at a common floating node of the resistors. This resistor connection is referred to as a resistive star and may be considered an N-terminal resistance element. The "free ends" of the splines are connected to the inner conductors of the branch lines as well as to the first ends of the resistors.

This Wilkinson divider structure provides even power division among the branch ports while isolating the branch ports from each other. The isolation results from (1) the presence of the resistive star which dissipates odd mode power entering from one of the branch ports and (2) the quarter wavelength length of the transition portion's splines which transform the short circuit merger of the splines at the common junction end of the splines into an open circuit appearance at the "free" end of the splines where the resistors are connected to the splines, thus maximizing the odd-mode voltage across the resistors for a given odd mode signal.

The Wilkinson divider was generalized for non-equal power division in an article entitled, "Split-Tee Power Divider" by Parad et al. at pages 91–95 of the *IEEE Transactions on Microwave Theory and Techniques* for January 1965. A strip line implementation of their design is illustrated in the article. In it the "splines" are of unequal width and the isolation resistors are of unequal values in order to provide matched uneven power division.

Both of the above structures suffer from the problem of having limited power handling capabilities due to limited conduction of heat away from the isolation resistors. In the Wilkinson structure the isolation resistors are suspended from the inner conductors. Thus, the inner conductors are the only available thermal conduction path for disposing of the heat generated by the resistor's dissipation of any odd mode power. These inner conductors do not provide good heat sinking. In the Parad et al. structure the odd-mode resistor contacts only the center conductor and the dielectric of the strip line, neither of which provides good heat sinking.

A technique overcoming these power limitations is disclosed in U.S. Pat. No. 3,904,990 to La Rosa. Transmission lines are used to space the odd mode resistors physically away from the "splines" of the divider. This allows high power resistors to be used with good heat sinking. This technique is also described in an article entitled, "A New N-Way Power Divider/Combiner Suitable for High Power Applications" by Gysel at pages 116–118 of the *Proceedings of the* 1975 *IEEE Microwave Theories and Techniques Seminar.* A strip line embodiment of this structure is mentioned in the article. Transmission lines are used to physically space the isolation resistors from the junctures of the inner conductor splines with their associated branch inner conductors. High power, grounded, heat sunk, external isolation resistors are matched to these transmission lines, thereby solving the heat dissipation problems of the earlier structures.

Iden et al. in U.S. Pat. No. 4,163,955 disclose a coaxial transmission line structure which uses this technique and steps and splines the transition portion of the inner conductor to provide the impedance transformations needed in a many branch divider. Individual coaxial transmission lines are used to space the odd-mode resistor associated with each branch line from its spline to allow the use of high power, grounded, heat sunk odd-mode resistors. The La Rosa, Gysel and Iden structures trade a problem of bulkiness for the power handling problems of the Wilkinson and Parad et al. structures.

Each of the above references is incorporated herein by reference.

High power coaxial transmission line power dividers are needed which are similar in size to low power dividers and have the same low loss characteristics or at least have only small increases in loss. This need is particularly acute in structures such as phased array antennas where many dividers are used and where small size and low weight are important for the overall structure.

N. R. Landry, in a patent application assigned to the present assignee and entitled, "High Power Coaxial power Divider," RCA Docket No. 73,318, Ser. No. 226,711 filed Jan. 21, 1981 describes and claims one technique for improving the power handling capabilities of coaxial transmission line power dividers without significantly increasing their bulk. This technique places the odd mode power dissipation resistor(s) in the space between the inner and outer conductors on an electrically insulating, thermally-conducting heat sink which is thermally connected to the outer conductor. This application is incorporated herein by reference.

The present invention is another technique for increasing the power handling capabilities of coaxial power dividers without significantly increasing their bulk.

In accordance with one preferred embodiment of the present invention, the lossiness, power handling and fabrication problems of the prior art matched coaxial transmission line couplers and, in particular, power dividers of the type having the common inner conductor split to form initial parallel portions of the branch legs are overcome by placing an odd mode power dissipation element inside a hollow interior defined by the initial portions of the branch legs. A thermally conducting element extends from the hollow interior defined by the branch legs to the outer conductor of the coaxial coupler to conduct heat away from the power dissipation element. A compact, high power, low-loss power divider results. A separate resistive star is not needed.

Figure 5:
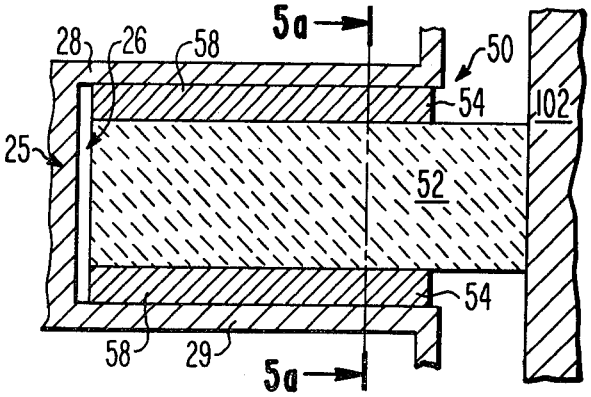
Figure 6A:
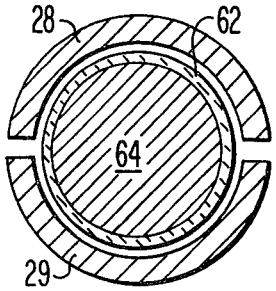
Figure 6:
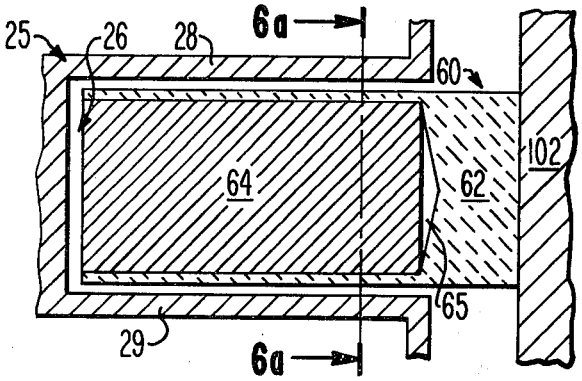
Figure 7A:
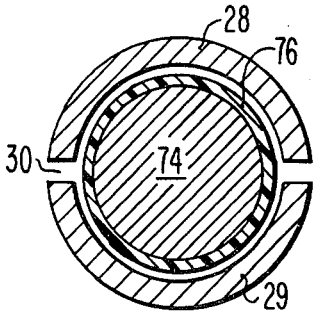
Figure 7:
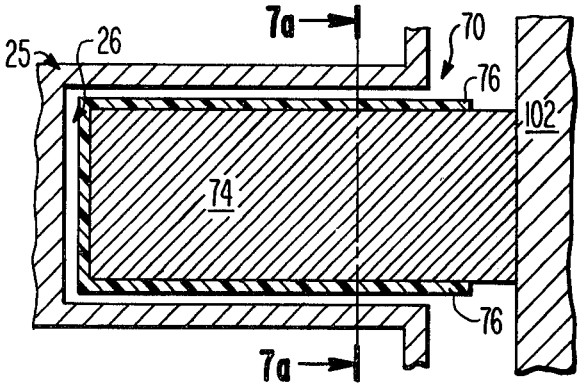
Figure 8:
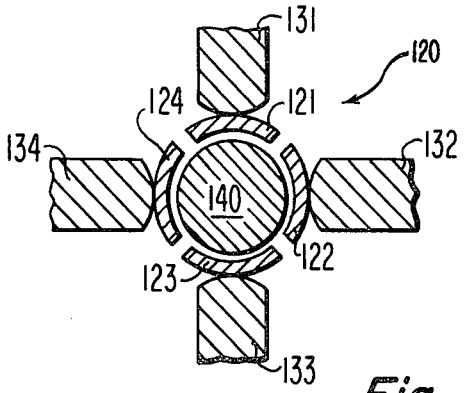
Figure 9A:
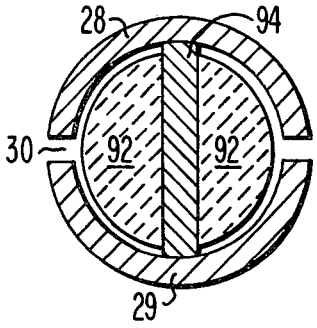
Figure 9:
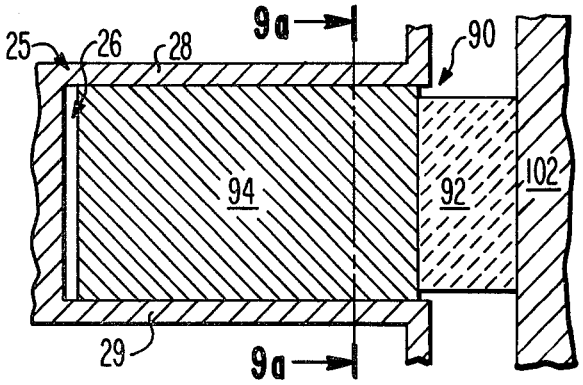

In the drawing:

FIG. 1 illustrates a coaxial transmission line coupling structure in accordance with the preferred embodiment of this invention wherein a portion of the outer conductor is removed to show the inner conductor system, FIG. 2 is a cross-section of the inner conductor system in FIG. 1 taken along the line 2—2, with some elements omitted for clarity, FIG. 3 is a cross-section of the inner conductor system in FIG. 1 taken along the line 2—2, FIG. 4 is a cross-section of the inner conductor system in FIG. 1 taken along line 4—4 in FIG. 3 according to one preferred embodiment, FIG. 4*a* is a sketch illustrating a cross-section taken along line 4*a*—4*a* in FIG. 4, FIGS. 5 and 5*a* are two cross-sections similar to those of FIGS. 4 and 4*a*, but of an alternative embodiment of the invention with FIG. 5*a* taken along line 5*a*—5*a* in FIG. 5, FIGS. 6 and 6*a* are two cross-sections similar to those of FIGS. 4 and 4*a*, but of a further alternative embodiment of the invention with FIG. 6*a* taken along line 6*a*—6*a* in FIG. 6, FIGS. 7 and 7*a* are two cross-sections similar to those of FIGS. 4 and 4*a*, but of a still further alternative embodiment of the invention with FIG. 7*a* taken along line 7*a*—7*a* in FIG. 7, FIG. 8 is a view similar to FIG. 3, but of a four-branch-line structure rather than a two-branch-line structure, and FIGS. 9 and 9*a* are two cross-sections similar to those of FIGS. 5 and 5*a*, but of an alternative configuration of a power dissipation system of the general type illustrated in FIGS. 5 and 5*a* with FIG. 9*a* taken along line 9*a*—9*a* in FIG. 9.

FIG. 1 illustrates a preferred inner conductor system 20 for a matched coaxial transmission line power divider 10 in accordance with the present invention. This inner conductor system 20 is enclosed by and spaced from an outer conductor 100 of which a portion is shown. A common leg 22 of the inner conductor system 20 merges with a common-line to branch-line transition portion or matching section 24 of the inner conductor which has a larger diameter to aid in matching the common line to the branch lines. The larger diameter portion 25 of the matching section 24 is split at point 26 into a plurality of splines 28 and 29 which are separated from each other along their lengths by slits or slots 30 (FIG. 2). The splines 28 and 29, in turn, merge into the branch inner conductor legs 32 and 34, respectively.

The point 26 constitutes a common junction from which the splines 28 and 29 emanate. The common junction 26 is where the separate branch lines begin electrically. Thus, the splines 28 and 29 each constitute a first portion of a branch inner conductor and the legs 32 and 34 each constitute a second portion of a branch inner conductor. As can be seen more clearly in FIG. 2, the splines 28 and 29 in this embodiment are curved in cross-section and are arranged to form a hollow cylindrical shell 27 which has an interior hollow 38 and whose longitudinal axis extends perpendicular to the upper in FIG. 2. The elongated shell 27 need not be cylindrical, its important characteristic being that the desired impedances and isolation are obtained. Most of the length of hollow 38 (along the length of splines 28 and 29) is occupied by an odd mode power dissipation system 40 (omitted from FIG. 2 for clarity) comprising a heat conducting element 42 and an odd mode power dissipation element 44 (FIGS. 1, 3, 4 and 4*a*).

Heat conducting element 42 is a good thermal conductor and may be a metal, but is preferably a dielectric such as beryllium oxide (BeO) or alumina ($Al_2O_3$). Element 42 extends from the hollow interior 38 that is, in a direction parallel to the longitudinal axis of the hollow 38) to the outer conductor 100 in axial alignment with the hollow 38 and is in good thermal contact with the portion 102 of outer conductor 100. This good thermal contact between heat conducting element 42 and outer conductor portion 102 may be obtained in any appropriate manner but may preferably be by a solder bond if element 42 and outer conductor portion 102 are both solderable or can be made solderable. Heat conducting element 42 also provides structural support for power dissipation element 44 in this embodiment. In this embodiment heat conducting element 42 is a solid cylinder and power dissipation element 44 is a cylindrical shell disposed thereon. These elements (42 and 44) need not be cylindrical provided their configuration provides the desired odd-mode power dissipation and interbranch line isolation and matching.

The power dissipation system 40 in this embodiment does not physically contact the splines 28 and 29 and power dissipation element 44 does not electrically contact them. Rather, its power absorption depends solely on its interception of electromagnetic fields extending between splines 28 and 29 within the hollow 38. Some other embodiments of the power dissipation system may provide physical contact without electrical contact while still others provide both physical and electrical contact.

No electric fields will be induced within the hollow 38 by even mode power applied to the coupling structure 10 along either common inner conductor 22 or the branch leg inner conductors 32 and 34. This is because for even mode power the potential will be the same at each point along the spline 28 as it is at the directly opposite point of the spline 29, i.e., at points on the splines which are equidistant from common junction 26. Therefore, there is no potential difference across and no electric field extending through the hollow 38. Thus, the odd mode power dissipation element 44 is physically isolated from all even mode electromagnetic fields which assures that element 44 will dissipate no even mode power.

In contrast, electric fields will be induced within the hollow 38 by odd mode power applied to the two branch conductors 32 and 34, independent of whether the odd mode power is due to differing amplitudes, frequencies or phases applied to the branch lines or due to unequal reflections of even mode power originally applied to common leg 22. These odd mode fields within hollow 38 are a result of potential differences between spline 28 and spline 29 at a given distance from common junction 26. Any such fields within hollow 38 encounter the power dissipation element 44. The lossiness of the power dissipation element 44 extracts energy from these fields thereby attenuating odd mode power by converting that power to thermal energy in the power dissipation element. The resulting heat is carried away by heat conducting element 42 and outer conductor 100. This technique for dissipating odd mode power may be referred to as space loading since it depends on electromagnetic fields in the space within the hollow 38 or potentials across this space. Details of the structure of the preferred power dissipation system are illustrated in FIG. 4 and FIG. 4*a*. FIG. 4 is a section taken along line 4—4 in FIG. 3. FIG. 4*a* is a cross-section taken along line 4*a*—4*a* in FIG. 4. The heat conducting element 42 is structurally supported by portion 102 of outer conductor 100 in addition to being in good thermally conducting contact therewith. Element 42 extends most of the length of hollow 38 between splines 28 and 29. A coating 44 of lossy material covers the portion of element 42 within hollow 38 to form the dissipation element 44. This lossy material may preferably be CERMET. A protective, electrically insulating overcoat or glaze 46 covers element 44 to provide environmental protection for element 44 and prevents electrical contact between element 44 and inner conductor system 20. The lossy material of element 44 is preferably electrically conductive (resistive) so that eddy currents can aid in dissipating the energy in any electromagnetic fields within hollow 38. The lossy element 44 preferably extends along the member 42 for substantially the entire length of hollow 38. This makes the power dissipation element a distributed one in contrast to prior art matched coaxial transmission line coupling structures which use discrete or lumped resistors as their power dissipation elements.

The power dissipation system 40, including its power dissipation element 44 is preferably disposed concentric to the elongated shell 27.

The degree of loss introduced by power dissipation element 44 may be adjusted to provide the desired degree of matching by adjusting the composition of element 44 to change its electrical resistance if electrical resistance provides the lossiness or to adjust the degree of loss where a lossy dielectric (a lossy ferrite for example) is used. The matching may be obtained in the same manner as in Wilkinson's article where a portion of the odd mode signal reaches the common junction of the branch legs. This component of the odd mode power is reflected and upon returning to the resistor cancels the portion of incoming odd mode power which is not absorbed by the resistor.

Alternatively, dissipation element 44 can absorb substantially all the odd mode power without inducing undesired reflections since it is distributed and thus (unlike lumped prior art systems), is not limited to a single point connection which acts as a voltage divider with the portion of the branch leg between its connection and the branch leg common junction.

A number of alternative embodiments for the power dissipation system are described hereinafter. Each of these embodiments can provide a similar performance. Which embodiment to use is largely a matter of design choice.

An alternative dissipative system 50 is illustrated in FIGS. 5 and 5*a*, where a heat conducting element 52 supports a coating of electrically resistive lossy material which constitutes a lossy element 54 similar to element 44 in FIGS. 4 and 4*a*. However, this element 54 includes a projecting contact region 58 (see FIG. 5) in alignment with, and making contact to, the center of each spline along substantially the entire length of each spline. As shown in FIG. 5*a*, the remaining portions of the outer surface of coating 54 may be covered by an electrically insulating glaze 56 like the glaze 46 in FIG. 4. However, this is not essential since the spacing effects of the projecting contact regions space the remainder of the element 54 from the conductive splines.

A further alternative dissipative system 60 is illustrated in FIGS. 6 and 6*a* where a body 64 of a lossy material such as a lossy ferrite is disposed within a hollow 65 in a heat conducting element 62. A ferrite such as Indiana General's Q1 material is lossy in the 0.5 to 5 GHz frequency band and is an appropriate composition for element 64 when the coupler is intended for use in this band. Once again the body 64 of lossy material extends most of the length of hollow 38.

A still further alternative dissipative system 70 is illustrated in FIGS. 7 and 7*a* where a body 74 of lossy material extends to the outer conductor 100 and fulfills the heat conducting function as well as the power dissipation function. The lossy material of body 74 may be a lossy ferrite such as Indiana General's Q1 material or a lossy electrical conductor (resistive material) such as Carborundum's Lossy Silicon. A glaze or other overcoat 76 preferably protects the lossy material of body 74.

In each of the above embodiments the element 44 or 54 or the body 64 or 74 of lossy material extends most of the length of hollow 38. This is preferred, but not necessary. If desired, the lossy material may be restricted to a small portion of the length of hollow 38. In that situation, it is preferable that the lossy material be disposed in the vicinity of $\frac{1}{4}$ wavelength from common junction 26.

An inner conductor system 120 for use with four branch lines is illustrated in end view in FIG. 8. The hollow splined transition section of system 120 has four splines 121, 122, 123 and 124, each of which is connected to its associated branch line inner conductor 131, 132, 133 and 134, respectively. Odd mode power dissipation system 140 may take the same form as any of the above discussed systems 40, 50, 60 and 70, with system 50 being modified to provide four contact regions 58 for providing electrical contact to each spline.

It is to be noted that the power dissipation system 140, if formed like any of the systems 40, 60 or 70, experiences no increase in complication with increases in the number of branch ports. If system 140 is formed like system 50, then as many contact regions 58 must be formed as there are branch lines or the element 54 must be made large enough to directly contact the entire inner surfaces of all the splines.

Prior art resistive star systems require as many separate resistors as there are branch lines (in the special case of two branch lines, the two resistors merge into one). A prior art four branch system would require a four "pointed" resistive star. Thus, the present space loading technique drastically simplifies divider fabrication whenever $n>2$, since a resistive star which is complicated to assemble and connect is not needed.

In each of these embodiments the problems of resistive star fabrication are eliminated by use of the space loading technique. Problems of heat conduction are minimized by the presence of the heat conducting element. The prior art problem of even mode power dissipation (due to displacement currents) which was identified by Landry and which is discussed in his co-pending application are eliminated (except in the case of a lossy heat conducting member) because even mode displacement currents do not flow in the odd mode power dissipation element.

Any capacitance introduced by the presence of the heat conducting member can be compensated for in a well known manner.

The illustrated embodiments each provide even power division. The same structures and techniques are applicable to uneven power splits. For uneven power slits, the elongated shell is not split into uniform size splines, but rather is split into splines having size ratios corresponding to the desired power split ratio. As is well known in the art, additional transformation is needed for uneven power splits in order to provide the desired matched characteristics. This additional transformation may be accomplished in the branch legs, if desired.

A modified version 90 of the dissipative system of FIGS. 5 and 5*a* is illustrated in FIGS. 9 and 9*a*. In this embodiment the power dissipation element 94 is not cylindrically concentric to the axis of hollow 38. Instead element 94 is a slab-like body of electrically resistive material which contacts both spline 28 and spline 29 and extends between them. Body 94 preferably contacts the splines along their longitudinal centers. Body 94 is positioned in a slot in thermally conducting element 92 in order to provide good thermal contact between element 94 and element 92 along the entire length of element 94. The embodiment of FIGS. 5 and 5*a* is preferred over the embodiment of FIGS. 9 and 9*a* because it is considered more efficient at dissipating odd mode power.

Preferred embodiments of a space loading technique for dissipating odd mode power in a coaxial transmission line coupling structure (power divider or combiner) have been illustrated and described. Those skilled in the art will be able to modify these embodiments without departing from the scope of the invention which is limited only by the appended claims.

What is claimed is:

1. A coaxial transmission line coupler for connecting a common port to n branch ports where n is an integer greater than 1, said structure designed for operation over a predetermined frequency band, said structure comprising:

an inner conductor system including a common leg and n branch legs, said branch legs extending from a common junction with said common leg, each branch leg having a first portion beginning at said common junction and extending a distance of about ¼ wavelength at a frequency within said band, said first portions of said branch legs disposed substantially parallel and together defining a hollow interior having an axis extending parallel to said first portions of said branch conductors;

an odd mode power dissipation element disposed within said hollow interior for dissipating any odd mode power;

an outer conductor enclosing said inner conductor system;

a thermally conducting element extending, in a direction parallel to said axis, from said power dissipation element within said hollow interior to said outer conductor for conducting, to said outer conductor, heat generated in said power dissipation element.

2. The coaxial transmission line coupler recited in claim 1 wherein said power dissipation element is concentric to the axis of said parallel extending first portions of said branch legs.

3. The coaxial transmission line coupler recited in claim 1 wherein the portion of said heat conducting element extending from said hollow interior to said outer conductor of said coupler is electrically insulating.

4. The coaxial transmission line coupler recited in claim 1 wherein:

said thermally conducting element is electrically insulating and extends into said hollow interior; and said power dissipation element includes a lossy film disposed on the surface of said thermally conducting element.

5. The coaxial transmission line coupling structure recited in claim 1 wherein:

said thermally conducting element is formed of the same material as and is an extension of said power dissipation element.

6. The coaxial transmission line coupler recited in claim 1 wherein said power dissipation element comprises an electrical resistance material.

7. The coaxial transmission line coupler recited in claim 6 wherein said electrical resistance material is disposed in electrically conducting contact to each of said parallel extending first portions of said branch legs.

8. The coaxial transmission line coupler recited in claim 6 wherein said electrical resistance material is distributed along the length of said hollow to provide a distributed odd mode power dissipation resistor.

9. The coaxial transmission line coupler recited in claim 1 wherein:

said thermally conducting element is electrically insulating and extends into said hollow interior; and said power dissipation element comprises a body of lossy material disposed within a hollow in said thermally conducting element.

10. The coaxial transmission line coupler recited in claim 9 wherein said lossy material is a ferrite.

11. A coaxial transmission line coupler for connecting a common port to n branch ports where n is an integer greater than 1, said structure designed for operation over a predetermined frequency band, said structure comprising:

an inner conductor system including a common leg and n branch legs, said branch legs extending from a common junction with said common leg, each branch leg having a first portion beginning at said common junction and extending a distance of about ¼ wavelength at a frequency within said band, said first portions of said branch legs disposed substantially parallel and together defining a hollow interior;

an odd mode power dissipation element disposed within said hollow interior for dissipating any odd mode power; said power dissipation element not electrically conductively connected to said parallel extending first portions of said branch legs and positioned to intercept any electromagnetic fields within said hollow interior to dissipate power carried by said electromagnetic fields;

an outer conductor enclosing said inner conductor system;

a thermally conducting element extending from said power dissipation element within said hollow interior to said outer conductor for conducting, to said outer conductor, heat generated in said power dissipation element.

12. The coaxial transmission line coupler recited in claim 11 wherein:

said thermally conducting element is electrically insulating and extends into said hollow interior; and said power dissipation element includes a lossy film disposed on the surface of said thermally conducting element.

13. The coaxial transmission line coupling structure recited in claim 11 wherein:

said thermally conducting element is formed of the same material as and is an extension of said power dissipation element.

* * * * *